US005529465A

United States Patent [19]

Zengerle et al.

[11] Patent Number: 5,529,465

[45] Date of Patent: Jun. 25, 1996

[54] MICRO-MINIATURIZED, ELECTROSTATICALLY DRIVEN DIAPHRAGM MICROPUMP

[75] Inventors: Roland Zengerle; Axel Richter, both of München, Germany

[73] Assignee: Fraunhofer-Gesellschaft zur Forderung der Angewandten Forschung E.V., Munich, Germany

[21] Appl. No.: 204,265

[22] PCT Filed: Jul. 28, 1992

[86] PCT No.: PCT/DE92/00630

§ 371 Date: Mar. 9, 1994

§ 102(e) Date: Mar. 9, 1994

[87] PCT Pub. No.: WO93/05295

PCT Pub. Date: Mar. 18, 1993

[30] Foreign Application Priority Data

Sep. 11, 1991 [DE] Germany ..... 41 30 211.7
Oct. 29, 1991 [DE] Germany ..... 41 35 655.1

[51] Int. Cl.[6] ..... F04B 43/04

[52] U.S. Cl. ..... 417/413.2

[58] Field of Search ..... 417/413.2, 413.3, 417/322

[56] References Cited

U.S. PATENT DOCUMENTS

| | | | |
|---|---|---|---|
| 4,939,405 | 7/1990 | Okuyama et al. | 417/413.2 X |
| 5,085,562 | 2/1992 | van Lintel | 417/413.2 X |
| 5,094,594 | 3/1992 | Brennan | 417/413.2 |
| 5,224,843 | 7/1993 | van Lintel | 417/413.2 |
| 5,336,062 | 8/1994 | Richten | 417/413.2 |

FOREIGN PATENT DOCUMENTS

| | | | |
|---|---|---|---|
| 0392978 | 10/1990 | European Pat. Off. . | |
| 4006152 | 8/1991 | Germany . | |
| 3-149370 | 6/1991 | Japan | 417/413.2 |
| WO90/15929 | 12/1990 | WIPO . | |

*Primary Examiner*—Richard E. Gluck
*Attorney, Agent, or Firm*—Wolf, Greenfield & Sacks

[57] ABSTRACT

An electrostatically driven diaphragm micropump comprises a first pump body as a counterelectrode and a second pump body having a diaphragm region. The two pump bodies establish a hollow space bordering on the diaphragm region and are electrically insulated from each other. The hollow space is filled with a medium different from the fluid to be pumped. The pump bodies may consist of a semiconductor material of different types of charge. The medium in the hollow space preferably has a high dielectric constant.

25 Claims, 4 Drawing Sheets

MICRO-MINIATURIZED, ELECTROSTATICALLY DRIVEN DIAPHRAGM MICROPUMP

FIELD OF THE INVENTION

The present invention relates to a micro-miniaturized, electrostatically driven diaphragm micropump.

DESCRIPTION OF THE PRIOR ART

A plurality of micro-miniaturized diaphragm pumps has already been known. In the technical publication F. C. M. van de Pol, H. T. G. van Lintel, M. Elwsenspoek and J. H. J. Fluitman "A Thermo-Pneumatic Micropump Based on Micro-Engineering Techniques" Sensors and Actuators, A21–A23 (1990), pages 198–202, a thermopneumatically driven diaphragm micropump is described. The realization of such a drive is very expensive.

Piezoelectrically driven diaphragm pumps are explained in detail in the technical publications F. C. M. van de Pol, H. T. G. van Lintel, S. Bouwstra, "A Piezoelectric Micropump Based on Micromachining of Silicon", Sensors and Actuators, 19 (1988), pages 153–167 and M. Esashi, S. Shoji and A. Nakano, "Normally closed Microvalve and Micropump", Sensors and Actuators, 20 (1989), 163–169.

The realization of these drive means includes manufacturing steps which do not belong to the standard technology steps of semiconductor technology, such as the step of glueing on a piezo film or a piezo stack, so that the manufacturing costs are high.

U.S. Pat. No. 5,085,562 already discloses a microminiaturized diaphragm pump having an outer diaphragm which is adapted to be deformed by a piezoelement. An inner pump chamber of the micropump is subdivided by a partition within which valve structures are arranged. The valves structures are a constituent part of stop means which limit the movement of the diaphragm relative to the partition or relative to the rest of the pump body so as to determine a constant amount of medium pumped per pumping cycle.

U.S. Pat. No. 5,224,843 discloses an additional micropump whose structure largely corresponds to the micropump which has just been assessed hereinbefore.

U.S. Pat. No. 5,336,062 discloses a micropump comprising a first pump body and a second pump body having a diaphragm region; each of said pump bodies have electrically conductive electrode areas which are adapted to be connected to a voltage source and which are electrically insulated from each other, said two pump bodies defining together a pump chamber bordering on the diaphragm region. The pump capacity of this micropump is not always satisfactory. The fact that the liquid to be pumped is acted upon by an electric field is in some cases unwanted.

SUMMARY OF THE INVENTION

It is the object of the present invention to provide a micro-miniaturized diaphragm micropump in which the liquid to be pumped will not, or only to a minor extent be acted upon by or exposed to an electric field.

This object is achieved by an electrostatically driven diaphragm micropump comprising:

a first pump body and a second pump body having a diaphragm region, said pump bodies having each electrically conductive electrode areas which are adapted to be connected to a voltage source and which are electrically insulated from one another, and a pump chamber provided with a flow direction control means and having a flow resistance which depends on the flow direction of the fluid to be pumped, wherein the two pump bodies define together a hollow space bordering on the diaphragm region, and the hollow space is filled with a fluid medium which is spatially separated from the fluid to be pumped, and the hollow space is arranged between the electrically conductive electrode area of the first pump body and the electrically conductive electrode area of the second pump body so that the fluid medium will be acted upon by the electric field generated between said electrically conductive electrode areas of the pump bodies, whereas the fluid to be pumped will not, or only to a minor extent be acted upon by said electric field.

Furthermore, it is the object of the present invention to provide a micro-miniaturized diaphragm micropump which can be produced easily and at a reasonable price and which has a high pump capacity.

This object is achieved by an electrostatically driven diaphragm micropump comprising:

a first pump body and a second pump body having a diaphragm region, said pump bodies having each electrically conductive electrode areas which are adapted to be connected to a voltage source and which are electrically insulated from one another, and a pump chamber provided with a flow direction control means and having a flow resistance which depends on the flow direction of the fluid to be pumped, wherein the two pump bodies define together a hollow space bordering on the diaphragm region, and the hollow space is filled with a fluid medium which is spatially separated from the fluid to be pumped, said fluid medium having a relative dielectric constant which is higher than 1.

Within the framework of the present invention, a new, electrostatic drive principle for micro-miniaturized diaphragm pumps is disclosed, which is characterized by an extremely simple structural design and which can be realized by the normal methods of semiconductor technology.

When the diaphragm micropump according to the present invention is used, the medium to be pumped is prevented from being exposed to the influence of the electrostatic field required as a drive means so that the diaphragm micropump according to the present invention can also be used for dosing medicaments which dissociate under the influence of electrostatic fields.

The diaphragm micropump is able to transport liquids and/or gases as well as to generate a hydrostatic pressure when the flow rate is zero.

The diaphragm micropump according to the present invention can, and this is a great advantage, be produced with the known methods used in the field of semiconductor technology. An additional advantage of the diaphragm micropump according to the present invention is to be seen in the fact that it can be used for transporting fluids of arbitrary conductivity A typical field of use of the diaphragm micropump according to the present invention is, for example, the precise dosage of liquids in the microliter and sub-microliter range in the medical sphere, or in technical fields, such as mechanical engineering.

According to a first aspect of the present invention, the diaphragm micropump comprises a hollow space defined by the two pump bodies and bordering on the diaphragm region, said hollow space being filled with a fluid medium which is spatially separated from the fluid to be pumped. The hollow space preferably has at least one opening through which said medium can flow out. According to a second aspect of the present invention, the diaphragm micropump comprises a hollow space defined by the two pump bodies and bordering on the diaphragm region, said hollow space being filled with a fluid medium which is spatially separated from the fluid to be pumped; said fluid medium has a relative dielectric constant which is higher than 1. The hollow space preferably has at least one opening through which said medium can flow out. The medium, which can also be referred to as an intensifying liquid or intensifying gas, preferably has a relative dielectric constant which is as high as possible so as to produce the strongest possible force which acts on the diaphragm region when a voltage is applied to the two pump bodies.

The fluid can be enclosed by the housing of the diaphragm micropump, and, consequently, it need not necessarily come into contact with its surroundings. When the fluid is enclosed in the housing, attention will have to be paid to the fact that, in cases in which a liquid is used, this liquid must not fill the hollow space in the housing completely, taking into account its infinitely small compressibility, since otherwise an escape of the liquid from the space between the first and second pump bodies (diaphragm region/ counterelectrode body) will no longer be possible and the diaphragm would no longer move due to the counterpressure built up by the liquid. Deviating from the above-described embodiment, in which the diaphragm micropump according to the present invention is not filled completely by the intensifying liquid, embodiments can also be taken into account in which the hollow space is filled completely with the intensifying liquid; in this case, the opening of the hollow space is, however, isolated from the ambient atmosphere by an extremely flexible additional diaphragm, which may consist e.g. of a rubber skin. The pump can also be operated with an intensifying gas having a dielectric constant which is higher than 1.

One or more passage openings in the counterelectrode body guarantee that, when a liquid is used as an intensifying means, said liquid can flow into and out of the space between the first and the second pump body (diaphragm region/ counterelectrode body) without having to overcome any major resistance. However, an increased pumping frequency of the electrostatic diaphragm micropump according to the present invention can be obtained by facilitating the flowing off of the intensifying liquid in the direction of the passage opening through channel structures in the diaphragm or the pump body located opposite the diaphragm.

The physical effect that dielectrics having a high dielectric constant will displace dielectrics having a lower dielectric constant in a capacitor guarantees that the liquid will automatically fill the space between the first and the second pump body (diaphragm/counterelectrode) provided that only one of the above-mentioned passage openings is in contact with the liquid filling. This filling process can additionally be facilitated by an adequate surface coating of the first and second pump bodies, at least in the areas of the diaphragm region coming into contact with the liquid, and of the third pump body as a counterelectrode.

It follows that, when additional fluid is used in the hollow space, the extra expenditure in connection with the housing technology required for this purpose will be comparatively low.

SHORT DESCRIPTION OF THE DRAWINGS

In the following, the subject matter of the invention will be explained in detail on the basis of embodiments with reference to the drawings, in which.

Figure 1:
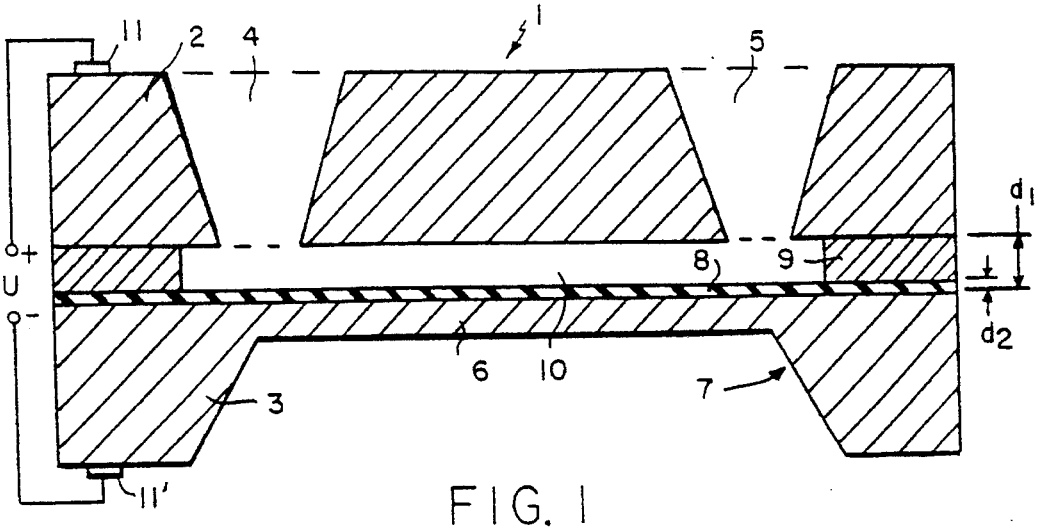
FIG. 1 shows a schematic sectional view for explaining the operating principle of an, electrostatic diaphragm micropump according to the present invention.
Figure 3A:
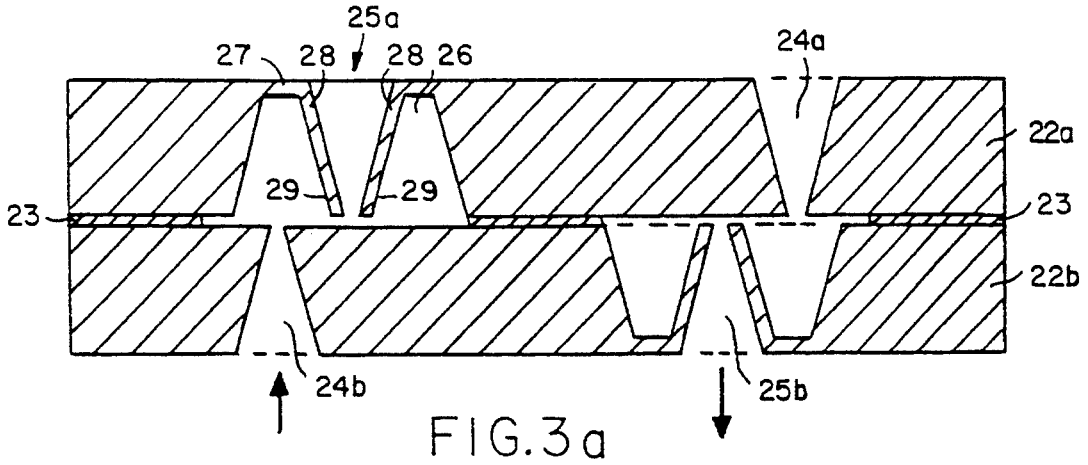
Figure 3B:
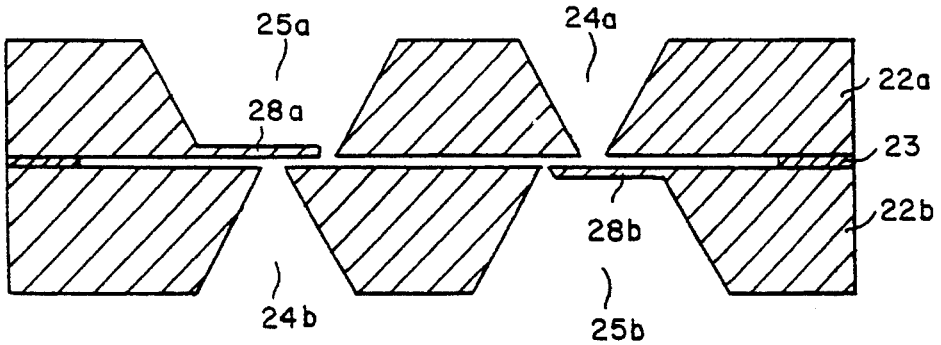
Figure 4:
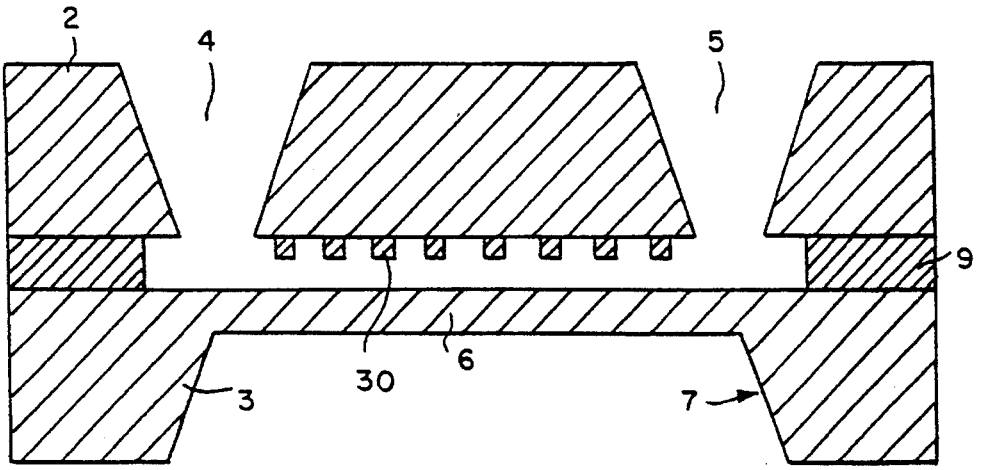
Figure 5:
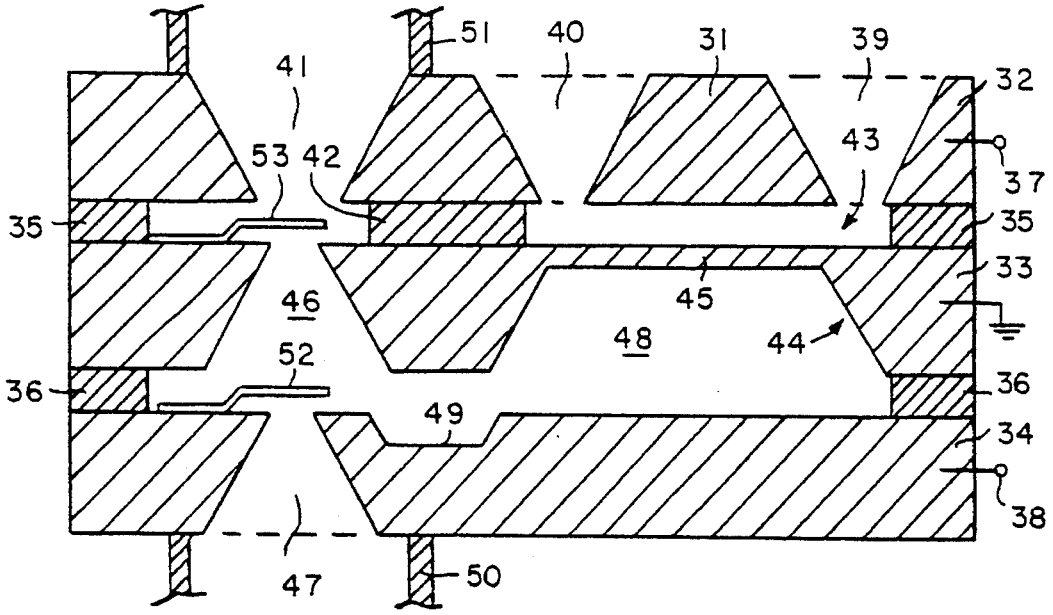
Figure 6:
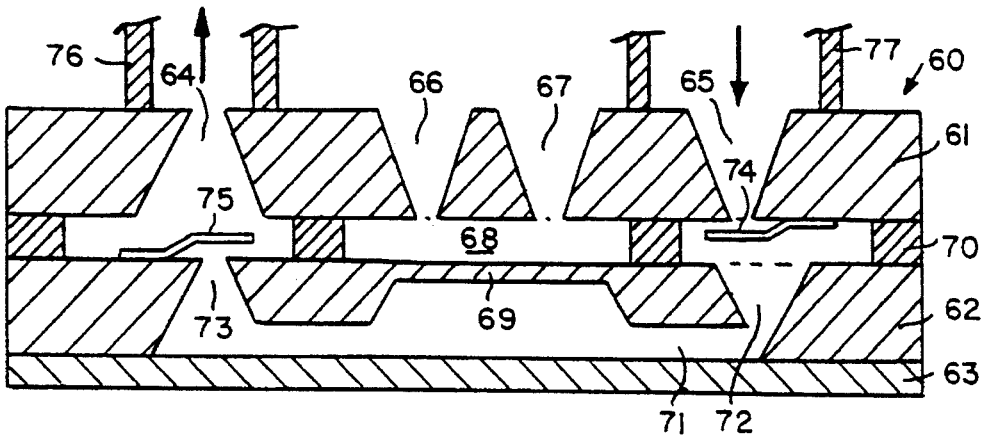
Figure 7:
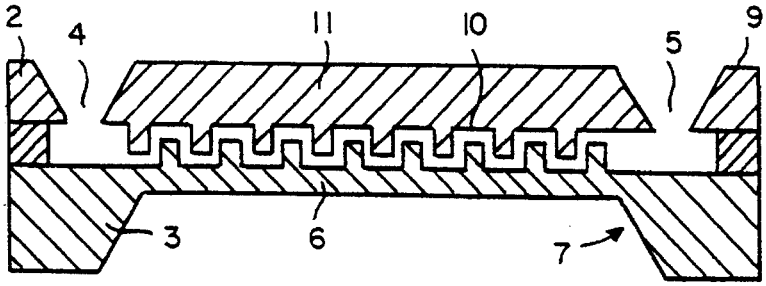

FIG. 3*a* shows a sectional view of a third pump body composed of two sub-pump bodies which are provided with valves;

FIG. 3*b* shows a sectional view of an alternative embodiment of the pump body structure according to FIG. 3*a*;

FIG. 4 shows a different structural design of a first pump body;

FIG. 5 shows a schematic sectional view of a different structural design of an electrostatic diaphragm micropump according to the present invention;

FIG. 6 shows a schematic sectional view of an additional embodiment of an electrostatic diaphragm micropump according to the present invention;

FIG. 7 shows a modification of the embodiment according to FIG. 1; and

Figure 8:
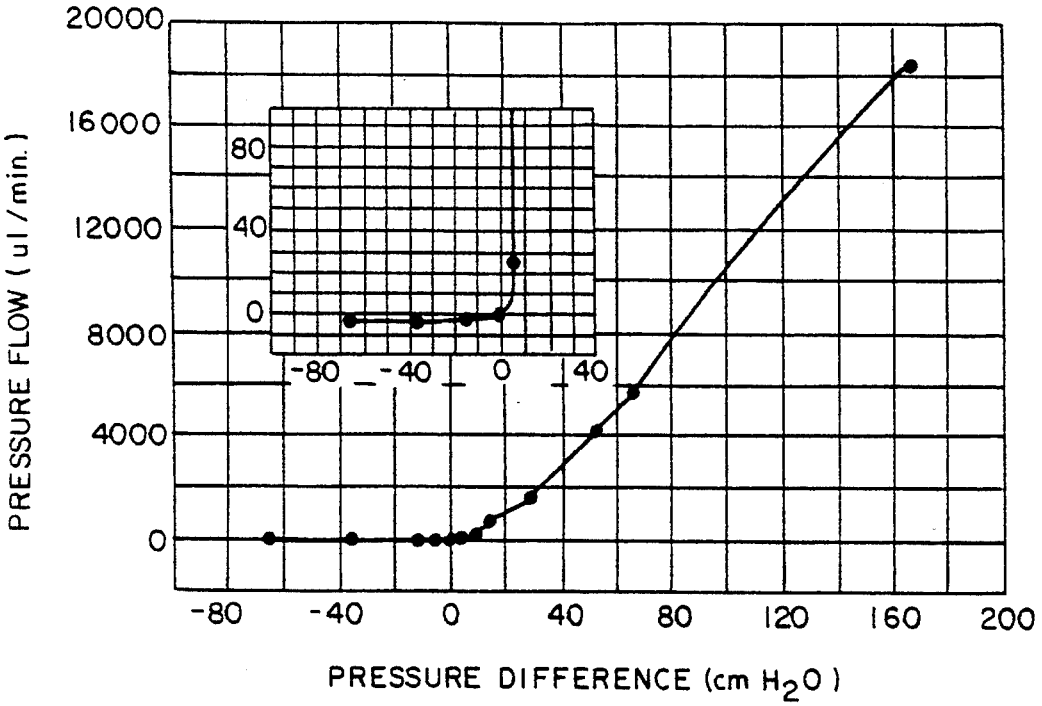

FIG. 8 shows a graphic representation of the connection between rate of flow and pressure difference for the valves used in the embodiment according to FIG. 3*b*.

DESCRIPTION OF THE PREFERRED EMBODIMENTS OF THE INVENTION

FIG. 1 shows a subunit of a micro-miniaturized electrostatically driven diaphragm pump according to the present invention, which is designated generally by reference numeral 1. A first pump body 2, which serves as an electrode area, is arranged above a second pump body 3 and is fixedly connected thereto. Second pump body 3 has a portion which serves as another electrode area. As used herein, the terms "electrode" and "counterelectrode" are synonymous. Both pump bodies 2 and 3 consist preferably of semiconductor materials of different charge carrier types. The first pump body 2 can, for example, consist of p-type silicon, the second pump body 3 being then made of n-type silicon.

The surface of the second pump body 3 facing the first pump body 2 is coated with a dielectric layer.

The side of the second pump body 3 facing away from the first pump body 2 is provided with a recess 7 which has the shape of a truncated pyramid and by means of which a thin, elastic diaphragm region 6 of small thickness is created. The recess 7 can be produced by photolithographic determination of a rear etch opening and by subsequent anisotropic etching.

The first pump body 2 has two passage openings 4 and 5 extending therethrough in the direction of its thickness. These two passage openings taper towards the second pump body 3.

In their marginal regions, the first and second pump bodies 2 and 3 are sealingly interconnected via a connection layer 9 whereby a space 10 is formed. The connection layer 9 may consist e.g. of Pyrex glass. The connection can be established by anodic bonding or by means of glueing. The distance d1 between the two surfaces of the first and second pump bodies 2 and 3 facing each other should be approximately in the range of from 1 to 20 micrometers. The space 10 between the first and second pump bodies 2 and 3 is filled with a fluid medium having a suitably high dielectric constant to such an extent that the liquid will extend up to and into the passage openings 4 and 5 or beyond said passage openings.

Although only indicated for the second pump body 3 in the present connection, the first pump body 2 or both pump bodies 2 and 3 may just as well be coated with a passivating dielectric layer 8 having an overall thickness d2 and the relative dielectric constant $\epsilon_2$, e.g. for preventing electric breakdowns. Furthermore, the dielectric can also fulfil the function of providing an advantageous surface tension for a specific liquid on the surfaces of the two pump bodies and 3 which face each other.

The surface of the first pump body 2 is provided with an ohmic contact 11 and the surface of the second pump body 3 is provided with an ohmic contact 11'. These two contacts 11 and 11' are connected to the terminals of a voltage source U.

By applying an electric voltage U between the pump body 3, which includes the diaphragm region 6, and the first pump body 2, which serves as a counterelectrode, charges which attract each other are generated on said pump bodies. The polarity of the voltage is preferably of such a nature that positive charges are generated on the p-type semiconductor and that negative charges are generated on the n-type semiconductor. The magnitude of the thus produced surface charge density on the first pump body 2 and on the second pump body 3 with its diaphragm region 6 is given by the capacity per unit area of the whole subunit 1 and results via the force of attraction between the charges in an electrostatically generated pressure $P_{el}$ acting on the diaphragm region 6 of the second pump body 3. This can be expressed by the following equation:

$$p_{el}=\frac{\epsilon_0\epsilon_1}{2}\cdot\frac{U^2}{d_1^2}\left[\frac{\epsilon_2 d_1}{\epsilon_2 d_1+\epsilon_1 d_2}\right]^2 \quad (1)$$

wherein $\epsilon_1$ is the relative dielectric constant of the medium in the space between the diaphragm region 6 of the second pump body 3 and the first pump body 2, and $\epsilon_2$ is the dielectric constant of a possible passivation layer 8. From this equation (1), it can be derived that the electrostatically generated pressure acting on the diaphragm region 6 can be increased decisively by choosing an adequate medium having a high relative dielectric constant $\epsilon_1$ and a high electric breakdown field strength, (with methanol e.g. by the factor $\epsilon_1$=32). The generally liquid medium in the area between the diaphragm region 6 and the second pump body 3 is normally different from the medium to be pumped and, primarily, it also has to fulfil a further prerequisite with respect to its conductivity. An insufficient specific resistance of the medium leads to a rapid reduction of the electrostatic field, which exists between the diaphragm region and the first pump body as a counterelectrode and which is used for pressure generation, within the characteristic time $\tau$, with $$\tau=\epsilon_0\left(\epsilon_1+\epsilon_2\frac{d_1}{d_2}\right) \quad (2)$$

The passage openings 4 and 5 formed in the first pump body 2 guarantee that the liquid can flow off unhindered from the space between the diaphragm region 6 of the second pump body 3 and the first pump body 2 and will thus not apply any counterpressure to the diaphragm region 6, which would prevent said diaphragm region 6 from moving in response to the electrostatically generated pressure.

Furthermore, equation (1) shows that the thickness $d_2$ of a possible passivation layer 8 should not exceed a specific value ($\epsilon_1 d_2<\epsilon_2 d_1$).

Typical magnitudes of pressures which can be produced and which act on the diaphragm region 6 are, in cases in which methanol is used as an intensifying medium ($\epsilon_1$=32), approx. 10000 Pa, the distance being $d_1$=5 m and the operating voltage being U=50 V for $\epsilon_1 d_2<<\epsilon_2 d_1$; this corresponds to a hydrostatic pressure of approx. 1 m water column and is, consequently, higher than the pressure occurring in connection with diaphragms which have hitherto been driven piezoelectrically or thermopneumatically. By further increasing the operating voltage U and by choosing another intensifying medium, it is also possible to generate still higher pressures which act on the diaphragm. Such a net pressure acting on a silicon diaphragm having a thickness of approx. 25 μm and side lengths of 3 mm×3 mm leads to a maximum diaphragm deflection of approx. 5 μm, and this corresponds to a volume displacement of approx. 0.02 μl over the whole area of the diaphragm.

The electrostatically generated pressure acting on the diaphragm region is practically stored in the diaphragm due to the deformation thereof and, when the voltage U has been switched off, it will have the effect that the diaphragm returns to its original position.

By varying the diaphragm thickness and its side lengths, other stroke volumes can be produced also in relation to a specific operating voltage.

It follows that, by applying a periodic electric voltage (preferably in the form of square-wave pulses) to the first pump body 2 as counterelectrode and to the second pump body 3 including the diaphragm region 6, the maximum frequency of said periodic electric voltage being determined by the flow-through characteristic of the valves on the diaphragm pump which will be described hereinbelow, a periodic displacement of a certain stroke volume is achieved, and this is the principal feature of a diaphragm pump.

A stroke volume of the pump which, as far as possible, is independent of or depends only very little on the counterpressure which has to be overcome by the liquid will be of great advantage for dosing small amounts of liquids. The properties of the electrostatic diaphragm pump according to the present invention which will be explained hereinbelow cause a constant stroke volume in a very elegant way.

The diaphragm drive of the pump according to FIG. 1 can be regarded as a series connection of two or more capacitances $C_1$, $C_2$. This is evident when, in FIG. 1, the boundary surface between the insulating layer 8 and the hollow space 10, which is filled with the liquid, is regarded as a fictitious capacitor plate. The capacitance $C_2$ is represented by the insulating layer 8, whereas the capacitance $C_1$ is represented by the liquid medium in the hollow space 10. This can be expressed by the following equation:

$$U_1=\frac{C_2}{C_1+C_2}\cdot U_0=\frac{\epsilon_2\cdot d_1}{\epsilon_1\cdot d_2+\epsilon_2\cdot d_1}\cdot U_0 \quad (3)$$

As far as a movement of the diaphragm is concerned, only the part $U_1$ of the externally applied voltage $U_0$ counts, said part $U_1$ being dropped across the capacitance $C_1$; according to equation (3), this results in the condition $\epsilon_1 d_2<<\epsilon_2.d_1$ (the largest part of the voltage $U_0$ is dropped across the smaller one of the two capacitances). If, however, the diaphragm approaches the counterelectrode, d1 will become smaller and there will be a critical distance $d_1$ at which $\epsilon_1 d_2<\epsilon_2 d_1$ applies. If the diaphragm approaches the counterelectrode still further, by far the largest part of the voltage $U_0$ will now be dropped across the insulating layer 8 and is thus lost as a driving force for a further movement of the diaphragm.

It follows that, in connection with this type of electrostatic drive, the diaphragm is only deflected up to a specific critical distance $d_1$, and this corresponds to a defined stroke volume. It follows that, by adapting the thickness of the insulating layer 8, it is possible to achieve, at sufficiently high operating voltages $U_0$, a pressure-independent stroke volume up to a specific maximum counterpressure p which has to be overcome; this is a great advantage as far as the precise dosage of liquids is concerned.

Figure 2:
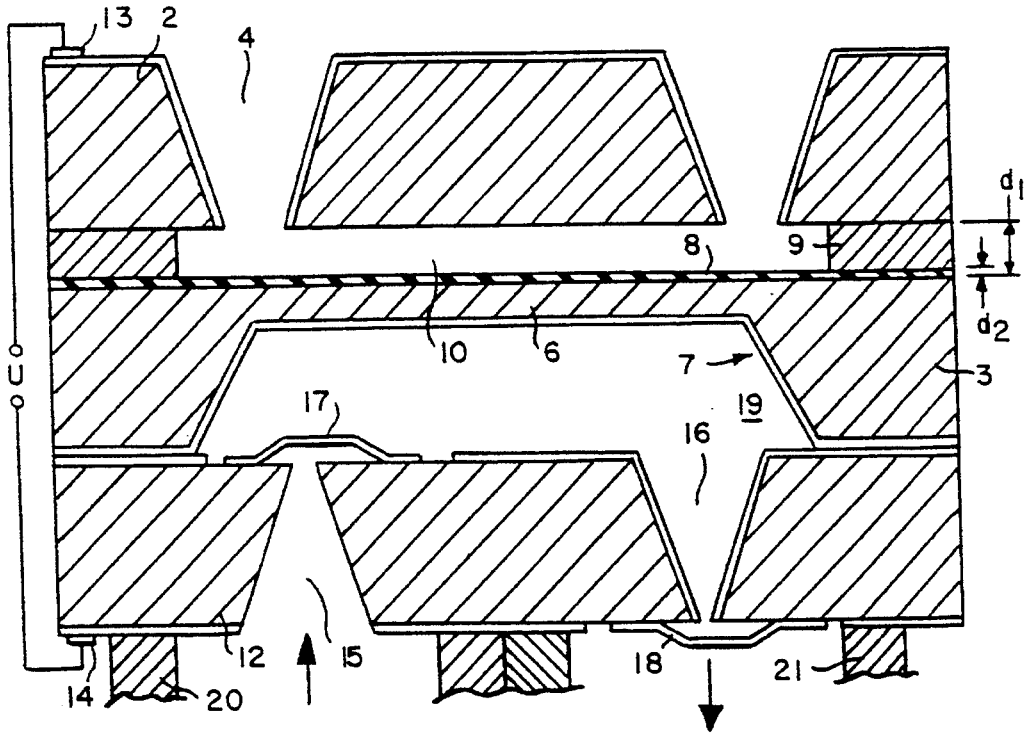
FIG. 2 shows in a schematic representation a cross-section through a first embodiment of an electrostatically driven diaphragm micropump according to the present invention.

FIG. 2 shows, in a schematic representation, a cross-section through a first, particularly simple embodiment of an electrostatically operating diaphragm pump according to the present invention. This diaphragm pump comprises the subunit 1, which has been described in connection with FIG. 1 and which includes first and second pump bodies 2 and 3, respectively, and, in addition, a third pump body 12 which is connected to the second pump body 3 by an electrically conductive and sealing connection. This connection can be produced e.g. by soldering or by eutectic bonding or by means of glueing. Also the third pump body 12 consists preferably of a semiconductor material of the same type as that of the second pump body 3, e.g. of n-type silicon.

The first and the third pump bodies 2 and 12 each have on the outer surface thereof an ohmic contact 13 and 14, respectively, and each of said ohmic contacts is connected to a terminal of a voltage source U.

The third pump body 12 is provided with two passage openings 15 and 16; passage opening 15 serves as a fluid inlet and passage opening 16 serves as a fluid outlet. Both passage openings 15 and 16 taper in the direction of flow of the fluid.

The surface of the third pump body 12 facing the second pump body 3 has provided thereon a check valve, which is defined by the passage opening 15 and the flap 17. The free surface of the third pump body 12 has provided thereon an additional check valve, which is defined by the passage opening 16 and the flap 18. In the present connection, the term check valve refers quite generally to a means characterized by different flow-through behaviours in different directions.

The third pump body 12 covers the recess 7 in the second pump body thus defining a hollow space 19, the pump chamber.

The free surface of the third pump body 12 has attached thereto a hose 20 connected to the passage opening 15 for supplying a fluid and a hose 21 connected to the passage opening 16 for discharging a fluid. Instead of the hose, it would also be possible to attach a suitable fluid line.

The periodic deflection of the diaphragm or diaphragm region 6, which has been described in connection with FIG. 1, results in a periodic change of the pump chamber volume which is compensated for by a respective flow of liquid through the check valves 15, 16, 17, 18. The fact that the check valves 15, 16, 17, 18 have different flow-through characteristics in the flow-through and blocking directions will result in a pumping effect in a defined direction. When a fluid underpressure prevails in the pump chamber, the check valve 17 will be opened and fluid will flow into the pump chamber. The check valve 18 remains closed. In response to a subsequent reduction of the pump chamber volume and the resultant increase in pressure, the check valve 18 will be opened and the check valve 17 will be closed so that a certain fluid volume will now be discharged from the pump chamber.

In accordance with a simple embodiment, the check valves in the third pump body 12 can be defined by passage openings which are spanned by a diaphragmlike thin layer, which, in turn, is provided with passage openings provided in spaced relationship with the passage opening extending through the pump body chip.

Such a structure can, for example, be produced by the sacrificial-layer technology. These check valves can either both be realized on one pump body chip, or they can be realized on two separate pump body chips, which are placed one on top of the other and bonded. The diaphragms spanning the passage openings may also be set back by surface recesses relative to the surface of the third pump body 12 and thus be protected more effectively.

Another embodiment of the check valve within the framework of the present invention is shown in FIG. 3*a*. In this embodiment, the third pump body 12 of the diaphragm pump shown in FIG. 2 is defined by two identical subcomponents 22*a* and 22*b*, which are interconnected in a head-to-head arrangement via a thin connection layer 23 only in the marginal regions and in the central regions thereof. In the inner region, which is surrounded by the layer 23, the surfaces of the two subcomponents 22*a* and 22*b* facing each other are spaced apart.

The connection layer 23 can be dispensed with. In this case, the subcomponents 22*a*, 22*b* are glued together at their end faces.

Each of the two subcomponents 22*a* and 22*b* is provided with a passage opening 24*a* and 24*b*, respectively, whose structural design is similar to that of the passage openings 15 and 16 of the third pump body 12. Furthermore, each of the two subcomponents 222*a* and 22*b* is provided with an additional passage opening 25*a* and 25*b*, respectively, which has a special structural design. The additional passage openings 25*a* and 25*b* have the same structural design so that it will suffice to describe only one of the passage openings 25*a*.

The passage opening 25*a* comprises a recess 26 which has the shape of a truncated pyramid and a preferably rectangular cross-section tapering in the direction of the free surface of subcomponent 22*a*. Subcomponent 22*a* is provided with a total number of four thin elastic connecting webs 27 on the side facing away from subcomponent 22*b*, only two of said connecting webs being shown in a, sectional view; these connecting webs are formed integrally with subcomponent 22*a* and they extend into the recess 26. The connecting webs 27 have a thickness of approx. 0.5 to 30 μm. The free edge portion of each connecting web 27 which projects into the recess 26 is followed by a lamellar portion 28 formed integrally with said free edge portion and extending in the direction of subcomponent 22*b*. Hence, four lamellar portions are provided, the two lamellar portions 28 shown in a sectional view and the other two which are not shown, said lamellar portions being, on the whole, arranged in such a way that they approach one another, their end faces 29 being positioned in the plane of the surface of subcomponent 22*a* facing subcomponent 22*b*.

Due to the thin connecting webs 27, a pressure difference across the two subcomponents 22*a* and 22*b* will cause a deflection of the lamellar portions 28 in a direction essentially perpendicular to the main surface of subcomponent 22*a* and 22*b*, respectively. When the lamellar portions 28 of one of the passage openings 25*a* and 25*b*, respectively, are pressed against the surface of the subcomponent 22*a* and 22*b*, respectively, which is located opposite the end faces 29 of said lamellar portions 28, the flow resistance will be increased or the flow of fluid through said passage opening may possibly also be interrupted, whereas a flow of fluid through the other passage opening 25*b* or 25*a* will take place.

If some other cross-sectional shape is used, e.g a triangular one, a corresponding number of connecting webs and lamellar portions is provided.

Electric contacting of the whole diaphragm pump can generally be effected by bonding or by means of the housing on the upper side of the first pump body and because of the electrically conductive connection between the second and third pump bodies—on the underside of the third pump body.

The whole inner side of the pump chamber 19 can be metallized and earthed via the contacting on the third pump body. This will have the effect that the medium to be pumped is not exposed to any electrostatic field while passing through the pump chamber 19. This may be of importance with respect to medical applications.

FIG. 3*b* shows a modification of the embodiment according to FIG. 3*a*. In the two figures, identical reference numerals have been used for identical parts so that it will not be necessary to explain these parts again. In the embodiment according to FIG. 3*b*, the connecting webs 27 and the lamellar portions 28 of the embodiment according to FIG. 3*a* are no longer provided. Instead of these components, valve flaps 28*a*, 28*b* are formed integrally with the subcomponents 22*a*, 22*b* and arranged on the sides of these subcomponents 22*a*, 22*b* which face each other. Hence, the subcomponents 22*a*, 22*b* can be etched together with the valve flaps 28*a*, 28*b*; these valve structures may consist of identical semiconductor chips bonded in a head-to-head arrangement. Hence, each chip has an area in which it is etched thin so as to form the flap 28*a*, 28*b* having a typical flap thickness of 1 μm to 20 μm, and an area in which the opening 24*a*, 24*b* is etched through. When the two chips have been bonded, an arrangement is obtained in which the flap of one chip is arranged on top of the opening of the respective other chip. Typical lateral dimensions of the flaps 28*a*, 28*b* are approx. 1×1 mm. A typical size of the opening on the smaller side is approx. 400 μm×400 μm.

The two flaps 28*a*, 28*b* are very elastic so that, depending on the direction of the pressure acting thereon, they will be pressed onto the opening 24*a*, 24*b* in one case and urged away from said opening in the other.

FIG. 8 shows a graphic representation of the rate of flow through the pump body valve structure according to FIG. 3*b* in response to the pressure difference. It can be seen that the valve structure according to FIG. 3*b* is characterized by a very high forward-to-backward ratio. This characteristic feature of the valve structure becomes particularly apparent in the flow rate/pressure difference dependence for little flow rates which is drawn on a different scale and which is incorporated in FIG. 8.

FIG. 4 shows an additional embodiment, which is similar to that shown in FIG. 1. Identical reference numerals have been used for parts having the same meaning.

The stroke volume of the diaphragm depends on the net pressure acting on the diaphragm region. On the one hand, it is primarily the electrostatically generated pressure and, consequently, the operating voltage U which are of importance, and, on the other hand, the hydrostatic pressure difference ΔP, which has to be overcome by the fluid to be pumped, is to be considered. It follows that, when a fixed operating voltage is used, the stroke volume of the diaphragm or of the diaphragm region primarily depends on Δp, and this is not desirable for many cases of use. In order to reduce this disadvantage or in order to eliminate it even completely, insulating elements 30, which are arranged in a netlike configuration, may be provided on the surface of the first pump body 2 facing the diaphragm region 6 of the second pump body 3, said first pump body 2 acting as a counterelectrode and said insulating elements 30 being provided as an alternative to or in addition to the electrostatic boundary described. These insulating elements 30 limit the stroke volume of the diaphragm region 6 bulging during the pumping operation and they have the effect that the stroke volume is almost pressure independent in the range of small pressure differences ΔP, as has been explained with reference to FIG. 1 (cf. equation 3).

FIG. 5 shows a different embodiment of an electrostatic diaphragm pump according to the present invention where, in contrast to the diaphragm pump shown in FIG. 2, the fluid inlet opening and the fluid outlet opening are located on opposite sides of the diaphragm pump.

The diaphragm pump in FIG. 5 is designated generally by reference numeral 31 and comprises first, second and third pump bodies 32, 33 and 34, respectively. The first and second pump bodies 32 and 33 and the second and third pump bodies 33 and 34 are respectively interconnected via a connection layer 35 and 36 in their marginal regions. The distance between the individual pump bodies is determined by the thickness of the connection layer 35 and 36, respectively. The connection layer can consist e.g. of Pyrex glass or of a solder.

The first pump body 32 is provided with an ohmic contact 37 and the third pump body is provided with an ohmic contact 38 for connection with a voltage source.

The first pump body 32 has three passage openings 39, 40 and 41, among which the two first-mentioned ones correspond to the passage openings 5 and 4 provided in the diaphragm pump according to FIG. 2 and have the same structural design as said passage openings 5 and 4. Also the third passage opening 41 has the shape of a truncated pyramid and tapers in the direction of the second pump body 33.

Between said first and second pump bodies 32 and 33, a connection layer area 42 is provided, which serves to delimit a chamber 43 for a dielectric fluid against the passage opening 41.

The second pump body 33 has a recess 44 on the side facing the third pump body 34, said recess 44 corresponding to the recess 7 provided in the second pump body 3 according to FIG. 2. Due to said recess 44, a thin, elastic diaphragm region 45 is defined. The second pump body 33 is provided with a passage opening 46 which is spaced apart from the recess 44 and which is in alignment with the passage opening 41 in the first pump body 32. The passage opening 46 has the shape of a truncated pyramid and tapers in the direction of the first pump body 33.

The third pump body 34 has a passage opening 47 which has the shape of a truncated pyramid and which tapers in the direction of the second pump body 33. The passage opening 47 is in alignment with the passage opening 46 in the second pump body 33.

A rear recess 44 in the second pump body 33 and the surface of the third pump body 34 facing the second pump body 33 define a pump chamber 48. On the pump chamber side located adjacent the passage opening 46, a recess is formed in the third pump body 34, whereby a connection passage 49 is defined between the pump chamber 48 and the area of the passage opening 46. During the pumping process, this connection passage 49 permits the fluid to be pumped to pass more easily from the pump chamber 48 into the area of the passage opening 46.

A supply hose 50 is secured to the free side of the third pump body 34 and connected to the passage opening 47 which serves as a fluid inlet opening. A discharge hose 51 is secured to the free side of the first pump body 32 and connected to the passage opening 41 which serves as a fluid outlet opening.

The passage opening 47 in the third pump body 34 is provided with a check valve 52 on the side facing the second pump body 33. The passage opening 46 in the second pump body 33 is provided with a check valve 53 on the side facing the first pump body 32.

In the course of a pumping process caused by the movement of the diaphragm region 45, an overpressure and an underpressure are generated alternately between the two check valves 52 and 53 in the area of the passage opening 46. In the overpressure phase, the check valve 52 will be closed and the check valve 53 will be opened so that fluid to be pumped will be discharged from the passage opening 41. In the subsequently generated underpressure phase, the check valve 53 will be closed and the check valve 52 will be opened so that fluid to be pumped can now flow through the passage opening 47 and the connection passage 49 into the pump chamber 48.

In the electrostatic diaphragm pump described hereinbefore in connection with FIG. 5, the first pump body 32 acting as a counterelectrode consists preferably of a p-type semiconductor substrate polished on one side, the second pump body 33 of an n-type semiconductor substrate polished on both sides, and the third pump body 34 of an n-type semiconductor substrate polished on one side.

The diaphragm pump according to FIG. 6 is designated generally by reference numeral 60 and comprises first and second pump bodies 61, 62 as well as a cover plate 63. The first pump body 61 has two passage openings 64, 65 for the fluid to be pumped as well as two passage openings 66, 67 for the intensifying fluid having the high dielectric constant, the two last-mentioned passage openings 66, 67 bordering on the hollow space 68. Below the hollow space 68, a diaphragm region 69 of the second pump body 62 is provided. The two pump bodies 61, 62 are interconnected by a connection layer 70 in their peripheral areas as well as in marginal areas of the hollow space 68. The second pump body 62 defines together with the cover plate 63 a pump chamber 71 extending up to the diaphragm region 69 on the one hand and merging with passage openings 72, 73 on the other. The first pump body 61 carries a first valve flap 74 in the area of its second passage opening 65, said valve flap 74 defining together with the passage opening 65 a check valve. The second pump body carries a second valve flap 75 defining together with the second passage opening 73 an additional check valve.

The first and second passage openings 64, 65 of the first pump body 61 are followed by the two fluid connections 76, 77.

FIG. 7 shows a modification of the embodiment according to FIG. 1. Identical reference numerals have again been used for parts of the embodiment according to FIG. 7 which correspond to those of FIG. 1. The embodiment according to FIG. 7 essentially differs from that according to FIG. 1 insofar as the diaphragm region 6 of the second pump body 3 and the oppositely located counterelectrode region 11 of the first pump body 2 have a riblike or comblike structure when seen in a cross-sectional view. On the basis of a given dielectric constant of the dielectric fluid in the hollow space 10 and a given voltage which is applied to the two pump bodies 2, 3, an increase in the electrostatic force acting on the diaphragm 6 will be achieved by this riblike or comblike structure.

Although, in the embodiment shown, the diaphragm pump contains in its hollow space a liquid, which is acted upon by the electric field as a fluid medium, and pumps a liquid, it is also possible to provide a gas, such as air, instead of the liquid and/or a gas to be pumped instead of the liquid to be pumped.

If, in a specific case of use, it is not a high pump capacity that matters, but only that the fluid to be pumped is not acted upon by the electric field, the hollow space may be filled with a fluid medium whose relative dielectric constant is 1 or smaller than 1. Air may be used as such a fluid medium.

We claim:

1. An electrostatically driven micropump comprising first and second electrically conductive electrode areas, each of said electrode areas being shaped to form at least part of a pump body, the second pump body having a diaphragm region, the electrode areas also being adapted to be connected to a voltage source and being electrically insulated from one another, said pump bodies defining together a hollow space bordering on the diaphragm region, the hollow space being filled with a fluid medium which is spatially separated from the fluid to be pumped, and a pump chamber with a flow direction control means and having a flow resistance Which depends on the flow direction of the fluid to be pumped, wherein said pump chamber borders on a side of said diaphragm region facing away from said hollow space.

2. The apparatus of claim 1 wherein said fluid medium has a relative dielectric constant which is higher than 1.

3. The apparatus of claim 1 wherein the electrically conductive electrode areas of the pump bodies circumscribe a space and at least a part of the fluid medium fills said space, the fluid to be pumped being outside of said space.

4. A diaphragm micropump according to claim 2 or claim 3, comprising said pump chamber, which is filled with the fluid to be pumped and which borders on the side of the diaphragm region which faces away from the hollow space.

5. A diaphragm micropump according to claim 2 or claim 3, wherein the at least one opening of the hollow space used for discharging a fluid medium is defined by at least one passage opening extending through the first pump body.

6. A diaphragm micropump according to claim 2 or claim 3, wherein the second pump body is followed by a third pump body, and the second pump body has a recess on the side facing the third pump body, said recess defining together with said third pump body the pump chamber.

7. A diaphragm micropump according to claim 6, wherein the third pump body has provided therein at least two passage openings which end in the pump chamber and the rate of flow through said at least two passage openings can be controlled by means of check valves.

8. A diaphragm micropump according to claim 7, wherein the check valves are arranged on the third pump body.

9. A diaphragm micropump according to claim 4, wherein the pump chamber is in fluid connection with an area followed by two passage openings, and the amount of fluid flowing through the two passage openings can be controlled by respective check valves.

10. A diaphragm micropump according to claim 9, wherein the pump chamber is connected to the area via a connection passage extending between the second and third pump bodies.

11. A diaphragm micropump according to claim 9, wherein said area is defined by a passage opening, which is formed in the second pump body and which, via check valves, is in fluid connection with passage openings formed in the first and second pump bodies.

12. A diaphragm micropump according to claim 6, wherein the third pump body consists of two interconnected subcomponents having each a first passage opening and a second passage opening, the first passage opening in one of said subcomponents being in fluid connection with the second passage opening in the other subcomponent, and the second passage opening has arranged therein lamellar portions extending at an acute angle to the direction of flow of the fluid, one end of said lamellar portions being connected, via thin, elastic connecting webs, to the subcomponent in the passage opening of which the lamellar portions extend, in the area of the side of said subcomponent facing away from the other subcomponent, and said lamellar portions extending such that they approach one another in the direction of the surface of the second subcomponent.

13. A diaphragm micropump according to claim 12, wherein the lamellar portions and the thin, elastic connecting webs are formed integrally with the respective subcomponent.

14. A diaphragm micropump according to claim 2 or claim, wherein the first and second pump bodies consist of semiconductor materials of opposite types of charge.

15. A diaphragm micropump according to claim 14, further including a third pump body consisting of a semiconductor material of the same type of charge as that of the second pump body.

16. A diaphragm micropump according to claim 14, wherein at least the first and the second pump body each have an ohmic contact.

17. A diaphragm micropump according to claim 14, wherein at least one of the first and second pump bodies has on at least one of the surfaces facing each other a layer of a passivating dielectric.

18. A diaphragm micropump according to claim 14, wherein the second and third pump bodies are interconnected in an electrically conductive manner.

19. A diaphragm micropump according to claim 3 or 2, wherein electrically insulating areas are provided on the surface of the diaphragm region facing the first pump body.

20. A diaphragm micropump according to claim 2 or 3, wherein the fluid to be pumped is a liquid.

21. A diaphragm micropump according to claim 2 or 3, wherein the fluid to be pumped is a gas.

22. A diaphragm micropump according to claim 2 or 3, wherein the fluid medium is a liquid.

23. A diaphragm micropump according to claim 2 or 3, wherein the diaphragm micropump has at least one opening which borders on the hollow space and through which this fluid medium can flow out.

24. A diaphragm micropump according to claim 2 or 3, wherein the fluid medium is a gas.

25. A diaphragm micropump according to claim 19, wherein the electrically insulating areas are arranged in a netlike pattern and the medium which fills the hollow space is methanol.

* * * * *